US007448416B2

(12) United States Patent
Harrison

(10) Patent No.: US 7,448,416 B2
(45) Date of Patent: Nov. 11, 2008

(54) DRYER FABRIC SEAM

(75) Inventor: James Harrison, Kanata (CA)

(73) Assignee: AstenJohnson, Inc., Charleston, SC (US)

( * ) Notice: Subject to any disclaimer, the term of this patent is extended or adjusted under 35 U.S.C. 154(b) by 11 days.

(21) Appl. No.: 10/599,080

(22) PCT Filed: Mar. 19, 2004

(86) PCT No.: PCT/CA2004/000417

§ 371 (c)(1),
(2), (4) Date: Nov. 2, 2006

(87) PCT Pub. No.: WO2005/090672

PCT Pub. Date: Sep. 29, 2005

(65) Prior Publication Data

US 2007/0181207 A1 Aug. 9, 2007

(51) Int. Cl.
*D21F 7/08* (2006.01)
*D21F 7/10* (2006.01)
*D03D 25/00* (2006.01)

(52) U.S. Cl. ..... 139/383 A; 139/383 AA; 162/358.2; 162/900; 162/903

(58) Field of Classification Search ..... 139/383 A, 139/383 AA; 162/358.2, 349, 900, 901, 903
See application file for complete search history.

(56) References Cited

U.S. PATENT DOCUMENTS 4,141,388 A * 2/1979 Romanski et al. ..... 139/383 AA
4,186,780 A * 2/1980 Josef et al. ..... 139/383 AA
4,418,726 A * 12/1983 Josef et al. ..... 139/383 AA
4,438,789 A * 3/1984 MacBean ..... 139/383 AA
4,824,525 A * 4/1989 Penven ..... 162/358.2
4,863,786 A * 9/1989 Green et al. ..... 442/241
5,343,896 A * 9/1994 Schroder et al. ..... 139/383 A
5,405,669 A 4/1995 Lidar
5,411,062 A * 5/1995 Lee ..... 139/383 AA
5,458,161 A * 10/1995 Scarfe ..... 139/383 AA
5,601,120 A * 2/1997 Kuckart et al. ..... 139/383 AA
5,769,131 A * 6/1998 Whitlock et al. ..... 139/383 AA
5,904,187 A * 5/1999 Davenport ..... 139/383 AA
6,065,505 A 5/2000 Fickers
6,079,454 A * 6/2000 Lee et al. ..... 139/383 AA
6,213,164 B1 * 4/2001 Ostermayer et al. ... 139/383 AA
6,241,081 B1 6/2001 Holden (Continued)

*Primary Examiner*—Bobby H Muromoto, Jr.
(74) *Attorney, Agent, or Firm*—Volpe and Koenig, PC

(57) ABSTRACT

An industrial fabric is described which comprises a woven fabric body having opposing ends. The fabric repeating weave pattern includes at least two systems of vertically stacked machine direction warp yarns interwoven with at least one system of cross machine direction weft yarns. On each end of the fabric at least some of the warp yarns form a first set of loops each of which is at a first angle to the machine direction, at least some of the warp yarns form a second set of loops each of which is at a second angle to the machine direction and each of the second set of loops is substantially concentric with the first set of angled loops to provide double end loops which can be seamed by using a coil seam or a pin seam. This fabric structure has the advantage that it is possible to use all of the fabric warp yarns in the loops, thus significantly increasing the tensile strength of the seam. It also permits the fabrication of a flatter seam. This seam design is of particular use in dryer fabrics for a paper making machine.

8 Claims, 2 Drawing Sheets

U.S. PATENT DOCUMENTS 6,450,213 B1 * 9/2002 Gauthier et al. ..... 139/383 AA
6,773,553 B2 * 8/2004 Hyvonen et al. ..... 162/358.2
7,025,095 B2 * 4/2006 Zils ..... 139/383 AA
7,093,621 B2 * 8/2006 Canon et al. ..... 139/383 A
7,207,355 B2 * 4/2007 Lee ..... 139/383 A
2004/0159362 A1 * 8/2004 Ogiwara ..... 139/383 AA
2004/0182467 A1 * 9/2004 Gstrein ..... 139/383 AA

* cited by examiner

DRYER FABRIC SEAM

BACKGROUND

The present invention relates to an improved, high loop density, woven back coil or 'pin seam for use in joining the ends of papermaker' and the like fabrics.

Woven fabrics, intended for use in either the forming, pressing or drying sections of paper making machines, are usually woven as a continuous strip which is converted into an endless loop by one of three methods:

(a) joining the opposed ends of the flat woven fabric with a permanent woven seam, such as is described, for example, in U.S. Pat. No. 3,366,355; or (b) joining the opposed ends of the flat woven fabric by forming small loops in the opposed ends of the fabric and then interdigitating these loop ends during installation of the fabric on the paper making machine to form a passageway through which a pintle is inserted to form a hinge-type joint referred to as a pin seam, such as is described, for example, in U.S. Pat. No. 4,182,381; or (c) joining the opposed ends of the flat woven fabric by forming small loops in each of the two opposed ends of the fabric, engaging each of the two sets of loops with a spiral coil and then interdigitating the two coils attached to the opposed fabric ends with each other to form a passageway through which pintle is inserted to form a hinge type joint, such as is described, for example, in U.S. Pat. Nos. 5,875,822; 6,065,505; 6,241,081; and 6,267,068.

SUMMARY

The present invention is concerned with the last two of these methods, and is more particularly concerned with the last of these. This form of seam is well known and is extensively used; it is commonly called a coil type. In both a pin seam and a coil seam, the warps are used to form the required loops, by removing some of the weft yarns from each of the fabric ends, and weaving back the exposed length of warp yarn into a nearby warp yarn path in the fabric end.

Because many industrial fabrics are commonly joined into a continuous loop following their installation onto the machine for which they are intended, this invention is of relevance to those types of woven industrial fabrics where a coil seam is appropriate or desirable. This invention is of particular relevance to those industrial fabrics having at least two warp layers in their construction wherein at least two distinct layers of warp yarns are located one over the other in the repeating fabric weave pattern, such that each warp yarn on one substantially planar fabric surface is in a stacked relationship with another warp yarn located on the opposite substantially planar surface of the fabric. Such fabrics are well known, and have been described by Lee in U.S. Pat. No. 5,092,373; U.S. Pat. No. 5,103,874; U.S. Pat. No. 5,117,865; U.S. Pat. No. 5,148,838; U.S. Pat. No. 5,167,261; U.S. Pat. No. 5,199,467; U.S. Pat. No. 5,230,371; U.S. Pat. No. 5,238,027; U.S. Pat No. 5,343,896; U.S. Pat. No. 5,411,062; U.S. Pat. No. 5,645,112; and U.S. Pat. No. 5,690,149. This invention thus applies more particularly to woven industrial fabrics having two separate layers of warp yarns in the fabric weave pattern such as those described in the Lee patents, which are intended for use as dryer fabrics in a papermaking machine.

Because of their length, dryer fabrics are almost always joined into an endless loop on the dryer section of the papermaking machine, and therefore this invention applies particularly to dryer fabrics, and applies more particularly to dryer fabrics in which a coil or pin type seam is used. This invention applies particularly to the two layer fabrics commonly used as paper making machine dryer fabrics.

Prior art seams suffer from several disadvantages including, but not limited to, the following:

1) the difficulty with which the loops or coils on the fabric ends are interdigitated and the pintle inserted into either the loops or the coils to close the seam during installation;

2) fabric failures caused by insufficient machine direction strength in the region of the seam, due to only a proportion of the warp yarns being utilised in the seam; and 3) marking of the moist paper web by the seam structure.

It is well known that a transverse seam is potentially a weak point in the fabric; seam failures are commonplace in all papermaking machines. It thus follows that it is highly desirable to provide either a pin seam, or a coil seam, whose tensile strength properties in the machine direction of the fabric are as near to, or even better than, those of the body of the fabric itself remote from the seam. Most prior art pin seams and coil seams are created by forming the required loops by using only half of the potentially available warp yarns; the other warp yarns are bent back around a weft and rewoven into the end of the fabric. Because the remaining 50% of the warps are not load bearing elements in the seam, the tensile strength of such seams cannot exceed 50% of the fabric tensile strength.

It is known to create coil seams by utilizing more than 50% of the available warp yarns to form the loops necessary to attach the spiral coil to the fabric ends. The coils used are typically fabricated from monofilaments formed from a thermoplastic polymer such as nylon, PPS or PEEK. The monofilaments generally have a substantially circular cross section, but other shapes such as ovate or rectangular may be used as disclosed for example by Fargeout in U.S. Pat. No. 5,875,822. As the number of fabric warp yarns used to provide the loops to attach the coil increases, the cross sectional area of the monofilament used to fabricate the coil must decrease, because the amount of space available to accommodate the interdigitation of the coil into the loops to form the seam decreases, due to the increase of the number of warp yarn loop used to attach the coil. If either the cross sectional area of the monofilament used in the coil, or the cross sectional shape of the monofilament used in the coil, or both is not altered to accommodate the increased number of loops used to attach it, then the seam becomes difficult to assemble and may not be smooth enough to be non-marking. But as the size of the monofilament used in the coil is decreased, the tensile strength of the seam will also decrease, which is also not desirable.

It is also well known that the seam itself, together with the two areas either side of it where the warp yarns used to provide the loops are woven back into the fabric ends, should not mark the paper which is being made. Seam marking can be caused in the dryer section by differential drying rates resulting from differences in air permeability in the seam area in comparison with the remainder of the fabric. Seam marking can also be caused by excessive pressure against the wet paper web of any raised portions in the area adjacent the seam resulting from the weaving back of the warp ends used to provide the loops.

In general, the seam should provide as little difference as possible in comparison with the body of the fabric with regard to both air permeability, surface smoothness, fabric end caliper, and seam tensile strength.

Numerous fabric designs, and seams for these fabric designs, have been proposed.

In a group of related patents including U.S. Pat. No. 5,092,373, U.S. Pat. No. 5,411,062, U.S. RE 35,966, U.S. Pat. No. 5,690,149 and others, Lee describes both a two layer fabric appropriate for use in the dryer section of a papermaking machine, and a seam structure for use in the described fabrics. Although fabrics within the designs described by Lee are in commercial use, the seam structure suffers from the disadvantage that, as described, only 50% of the warp yarns are used in creating the loops required by a pin seam. Lee does not consider the use of a coil seam.

Further, an advantage proffered for the seam described by Lee is that the seaming loops are parallel to the machine direction, which facilitates pintle insertion. But this is only achieved by reweaving the loop forming warp yarn back into the path of the warp yarn immediately beneath the loop forming yarn in the stacked arrangement described for the fabric, and by obtaining the space required to interdigitate the loops by only using alternate warp yarns to for the loops. The intervening non-loop forming yarns are bent back around a weft and rewoven into the end of the fabric.

In U.S. Pat. No. 5,601,120 Kuckart et al. a pintle seam structure is described for a two layer fabric suitable for use in the dryer section of a paper making machine. In the seam structure as described by Kuckart et al., the flat rectangular cross section warps are used in making double layer loops, comprising pairs of warps in which one warp is from the paper side layer of the fabric, and the other warp is from the machine side layer of the fabric. In each loop, the machine side layer warp is bent back for reweaving into the fabric end to a first path, and the paper side layer warp is bent back around the outside of the loop in the machine side layer warp for reweaving into the fabric end to a second path. However, although these double layer loops have increased strength, in this seam structure as described only 50% of the stacked flat warp yarns are used in making the two layer loops. As the warp yarns in the fabric as described are vertically stacked above each other, the loops have to be woven back into the path of a warp yarn immediately beneath the warp yarns used to form the loops.

Fickers et al. in U.S. Pat. No. 6,065,505 and in U.S. Pat. No. 6,267,068 disclose a stitched helix seam, which is visually similar to a coil seam, for a woven dryer fabric. Seams of this type are generally used at the side edges of the dryer fabric so as to increase the seam tensile strength. As described, the stitched helix seam is sewn in the cross-machine direction onto the opposed ends of the fabric, and utilizes all of the machine direction warp yarns to attach the helix to the fabric end, thus maximising the tensile strength of the helix seam. The stitched helix coil is retained in place by at least one weft yarn, and the warp yarns are woven back directly beneath themselves so as to retain the stacked warp arrangement characteristic of the fabrics for which this seam is suitable. The opening formed in the fabric by the warp loops in this seam construction is thus substantially horizontal.

Holden, in U.S. Pat. No. 6,241,081 described a modified coil seam arrangement, in which the seaming coil is retained by both short loops and long loops formed in the warp yarn ends. The weave pattern does not provide warp yarns located in a stacked arrangement. Although some aspects of the seam described by Holden are similar to the seam of this invention, Holden does not describe a coil seam in a multilayer fabric of the type described in the Lee patents mentioned above.

This invention seeks to provide a seam structure for an industrial fabric such as a paper maker's fabric, and in particular for a multi-layer paper maker's dryer fabric, having at least two layers of warp yarns, in which the disadvantages noted above are at least minimised, if not overcome. In particular, this invention seeks to provide a seam structure for an industrial fabric, in particular for a multi-layer paper maker's dryer fabric, having at least two layers of warp yarns, in which all of the fabric warp yarns can be used in creating the loops for the seam.

Thus in a first embodiment this invention seeks to provide an industrial fabric comprising a woven fabric body having opposing ends, the fabric body having at least two systems of vertically stacked machine direction warp yarns 5 interwoven with at least one system of cross machine direction weft yarns; on each end of the fabric at least some of the warp yarns form a first set of loops each of which is at a first angle to the machine direction; at least some of the warp yarns form a second set of loops each of which is at a second angle to the machine direction and each of which second set of loops is substantially concentric with the first set of angled loops to provide double end loops.

Preferably, the first set of angled loops and the second set of angled loops are created in adjacent warp yarns.

More preferably, the first set of angled loops and the second set of angled loops are created in adjacent warp yarns and each set of loops is created in 50% of the warp yarns in the system of warp yarns.

Preferably, the first angle, and the second angle are similar.

Preferably, the first angle and the second angle are not in the same direction relative to the machine direction. Alternatively, the first angle and the second angle are in the same direction relative to the machine direction.

Preferably, in a pair of opposed fabric ends prepared for a coil seam, the direction of the first angle, and of the second angle relative to the machine direction is chosen so that the openings defined by the loops matches the direction of the spiral angle in the coil to be used to close the seam.

In a second embodiment this invention seeks to provide a paper makers fabric, for use in the dryer section of a paper making machine, the fabric having a machine side, a paper side, and a machine direction, and having opposite ends each of which ends includes seaming loops, the fabric comprising in combination:

- a first set of monofilament warp yarns located in the machine direction,
- a second set of monofilament warp yarns located in the machine direction, and
- at least one set of monofilament weft yarns located in the cross machine direction, the two sets of warp yarns and the weft yarns being interwoven to a repeating weave pattern in which:
- the first set of warp yarns provides exposed floats on the paper side of the fabric, the second set of warp yarns provides exposed floats on the machine side of the fabric, and
- each of the yarns of the first set interweave with a weft yarn to form a knuckle between the weft yarn and an exposed float in the second set, each of the yarns of the second set interweave with a weft yarn to form a knuckle between the weft yarn and exposed float in the first set, and
- the first set of monofilament warp yarns is located in the weave pattern directly above the second set of monofilament warp yarns wherein
- a first set of seaming loops comprises the exposed ends of each of the first set of warp yarns bent to form a first set of loops each of which is at a first angle to the machine direction and the remainder of each exposed warp yarn end is rewoven into the next adjacent warp path of a warp yarn from the second set of warp yarns and in correlation with the weave pattern of that next adjacent warp path; and
- a second set of seaming loops comprises the exposed ends of each of the second set of warp yarns bent to form a second set of loops each of which is at a second angle to the machine direction, each of which second set of loops is substantially concentric with the first set of angled loops and the remainder of each exposed warp yarn end is rewoven into the next adjacent warp yarn path from the first set of warp yarns and in correlation with the weave pattern of the fabric.

In the context of this invention the following terms are to be understood to have the meanings given hereafter for them.

The term "machine direction" refers to a direction coincident with or substantially parallel to the direction in which a fabric moves in use, for example in a paper making machine.

The term "cross machine direction" refers to a direction coincident with or substantially parallel to the surface of the fabric and which is substantially perpendicular to the machine direction.

The term "warp path" refers to the path in the repeating fabric weave pattern which is occupied by a selected warp yarn.

The term "float" refers to a length of warp yarn which passes over, or under, a group of weft yarns without interweaving with them; the associated "float length" refers to the length of a float, expressed as a number indicating the number of yarns passed over, or under.

The term "stacked" refers to a repeating weave pattern design in which the warp yarns in each layer are located essentially vertically above each other.

BRIEF DESCRIPTION OF THE DRAWINGS

The invention will now be described in one embodiment and in more detail with reference to the attached Figures in which.

DETAILED DESCRIPTION OF THE PREFERRED EMBODIMENTS

Figure 1:
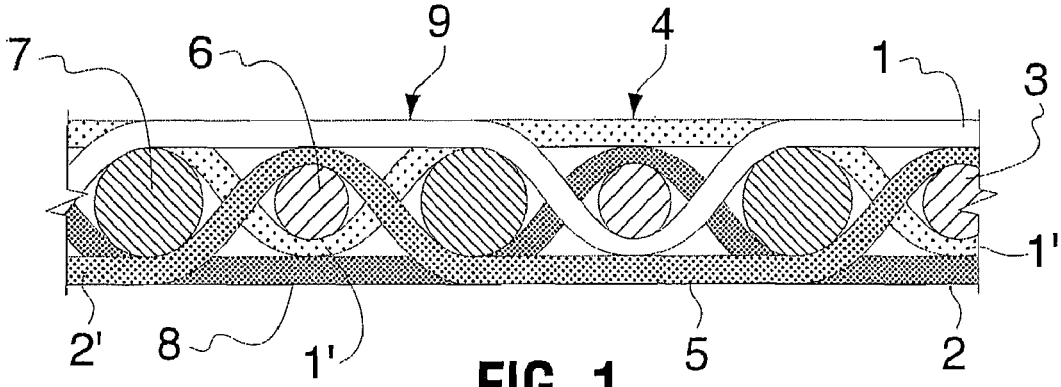
FIG. 1 shows schematically a section taken through a 5 two lawyer two layer fabric in the machine direction essentially parallel to the warp yarns.

Referring first to FIG. 1 the fabric section shown is taken in the machine direction, essentially parallel to the warp yarns, of a two layer fabric constructed according to the teachings of the Lee patents noted above. The fabric shown is a commercially available one, and is but a single example of a multilayer dryer fabric. The fabric shown is a two layer fabric utilising two sets of warp yarns, and one set of weft yarns. This fabric design is also used in FIGS. 2, 3, 4 and 5.

Referring now in more detail to FIG. 1, the fabric shown is a two layer fabric with two sets of warps as at 1 and 2 and 1' and 2', interwoven with a single set of wefts of two differing diameters as at 6 and 7. The warp yarn paths occupied by the warps 1 and 2 are essentially stacked above each other. Each path provides exposed floats in the fabric paper side layer as at 4 and 9 and in the machine side layer as at 5 and 8. Inside these exposed floats it can be seen that a warp yarn from the other surface of the fabric interweaves with a weft yarn to pass between that weft yarn and the adjacent warp yarn float. It can be seen that in the paper side warp 2' passes between weft 6 and float 9 in warp 1, while in the machine side surface of the fabric warp 1' passes between weft 6 and float 8 in warp 2. This fabric construction ensures that the two warps 1 and 2 and 1' and 2' are always stacked essentially one vertically above- or below- the other.

Figure 2:
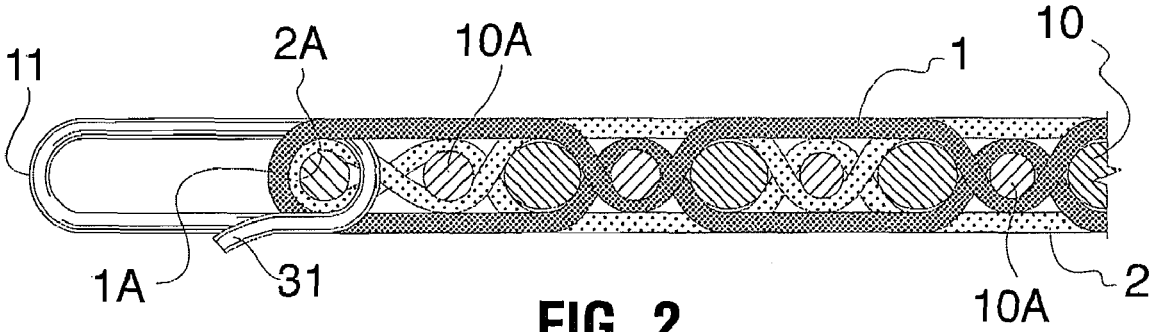
FIG. 2 shows schematically a section taken through the end portion of a fabric in the machine direction essentially parallel to the warp yarns showing a spiral coil entered into the seaming loops.

FIG. 2 shows a section in the same direction as in FIG. 1 of the end of the fabric as prepared for seaming. FIG. 2 shows only the last few wefts in the fabric end portion; the initial parts of the warp paths adopted for reweaving the ends of warps 1 and 2 back into the fabric ends are also shown. These paths will commonly be several centimetres in length, and each warp will be woven back in concordance with the fabric weave repeating pattern of each chosen warp path.

Referring now in more detail to FIG. 2, it can be seen that each of warp 1 passes over weft 10 and passes beneath both weft 10 and warp 2, so that warp 2 is again located between weft 10A and warp 1. Seaming loops are created in both warp 1, as at 1A and in weft 2 as at 2A. It can also be seen that all of the wefts are not necessarily of the same diameter. The wefts 10 and 10A alternate; with weft 10A being somewhat smaller than weft 10.

This FIG. also shows a seaming coil 11 engaged with the two loops 1A and 2A, as indicated by the cut end 31 of the coil 11. It can thus be seen that all of the machine direction warps are utilised in engaging the fabric end with the seaming spiral. It an also be seen that the spiral coil 11 as used in the seam structure, is located in the apertures formed in the space within the loops 1A and 2A. By weaving each of the sets of warps represented by warp 1 and warp 2 into the path of a warp immediately adjacent to the warp with which it is stacked the loops are created at an angle to the machine direction. It then also follows that when the seam is in use and is placed under tension the two loops 1A and 2A are able to move and occupy less space. This in its turn provides a level of choice in selecting the shape and cross sectional area of the monofilament yarn used to construct the spiral coil.

Figure 3:
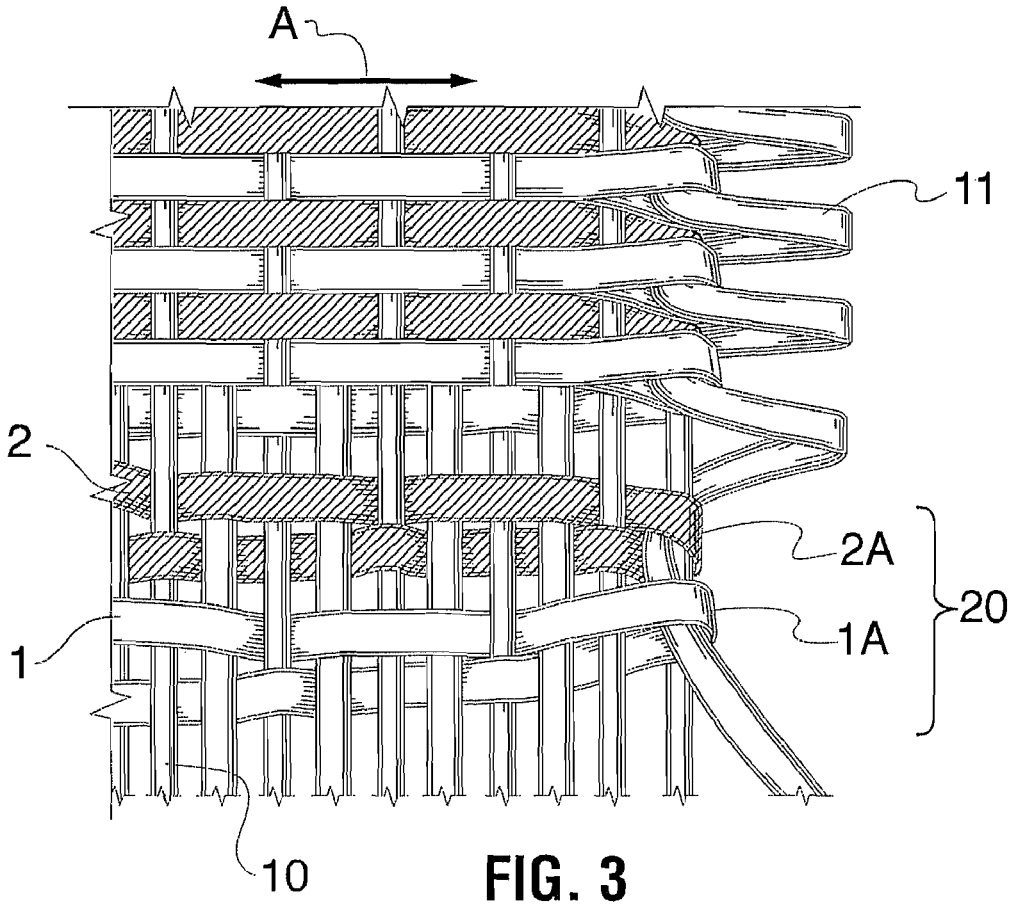
FIG. 3 shows a the paper side surface of the portion of the fabric shown in FIG. 2.

FIG. 3 shows in more detail the paper side surface of the fabric end shown prepared for seaming in FIG. 2. Three features of the seam structure can be seen in FIG. 3.

First, it can be seen as at area 20 that the loop in warp yarn 1 is formed around the outside of the loop in warp yarn 2 and is more or less concentric with it, even though the loop in yarn 1 is angled relative to the loop in yarn 2, and both are angled relative to the machine direction of the fabric. This is achieved by reweaving warp yarn 1 into the path of the warp yarn adjacent to its original path, which places warp yarn 1 beneath warp yarn 2 in the machine side face of the fabric. This location an also be seen in FIG. 2. Similarly, warp yarn 2 is also rewoven into the warp yarn adjacent to its original path. By utilizing yarn paths adjacent to the same side of the path for warp 1 and the path for warp 2 all of the loops can angled in the same direction relative to the machine direction.

Second, the adjacent warp yarn path—in FIG. 3 this can be above or below the path of the yarn 1—can be chosen to angle the loop in warp yarn 1 to either side. It then follows that the choice can be made to ensure that the warp yarn loops are in registration with the loops in the coil 11. This will simplify coil insertion into the loops.

Third, it can also be seen that the first angle for the loop 1A in warp 1 and the second angle for the loop 2A in warp 2 are not necessarily the same. Further, as shown in FIG. 3 the angle for loop 1A is in the opposite direction relative to he machine direction shown by the arrow A in FIG. 3. Further, it can also be seen that the third angle, that is the angle of the double loop as a 1A and 2A also is often not the same as either the first angle or the second angle.

Figure 4:
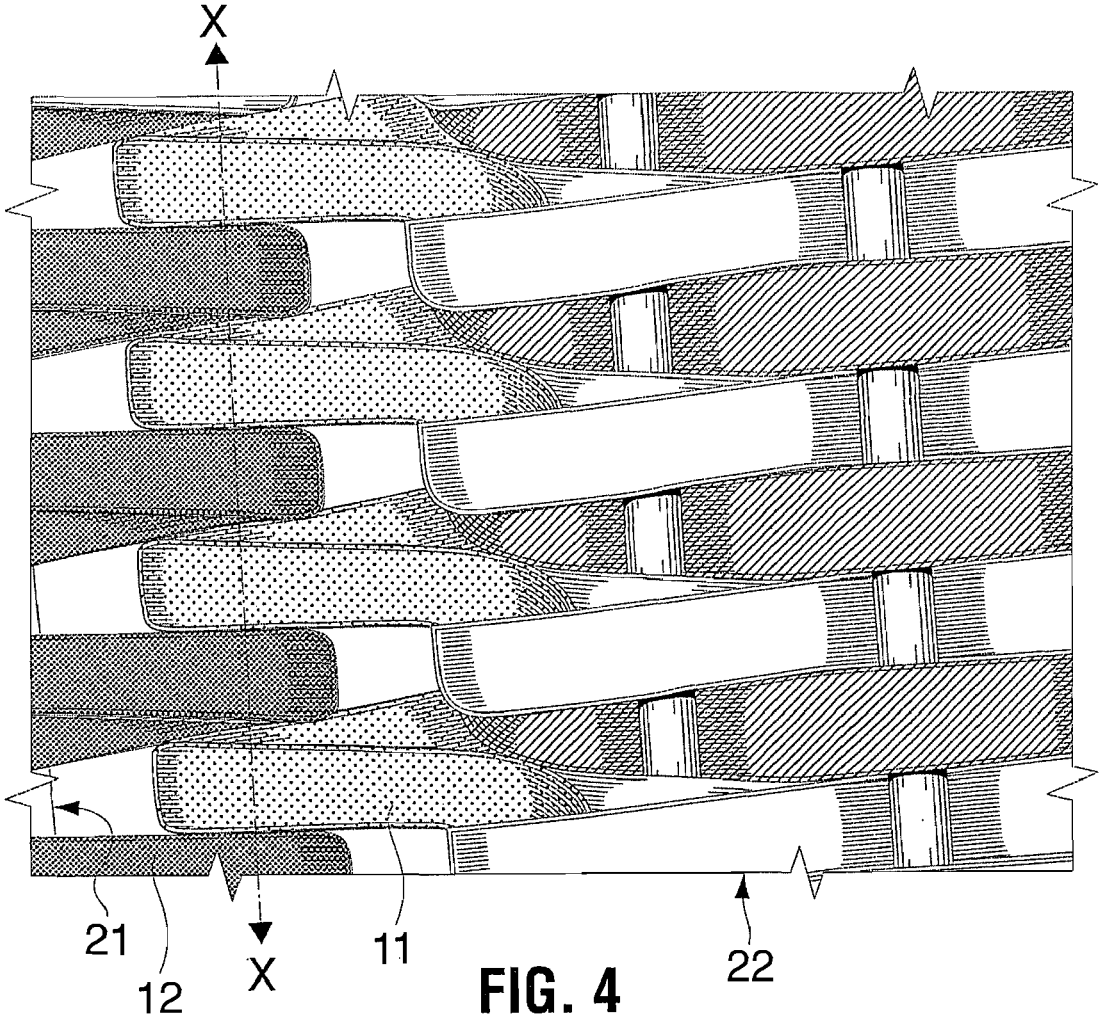
FIG. 4 shows two fabric ends prepared for seaming with the two spiral coils interdigitated ready for insertion of a pintle to complete the seam.

FIG. 4 shows the seam of this invention ready to have the pintle wire inserted into the two spiral coils 11 and 12. These two coils are each interdigitated into two sets of loops on two prepared opposing fabric ends 21 and 22, both of which have been prepared as shown in FIGS. 2 and 3. Insertion of a pintle along the line shown schematically at X-X serves to close the seam.

Figure 5:
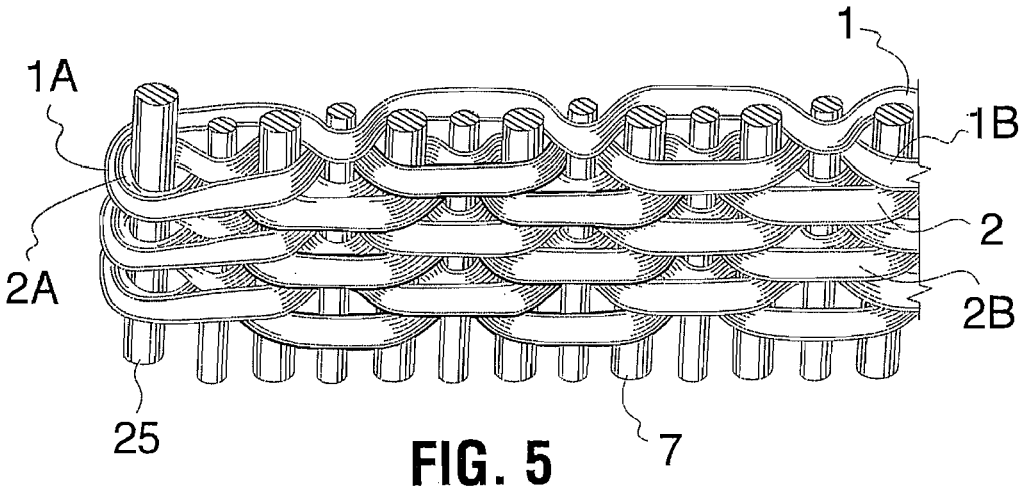
FIG. 5 shows schematically a part sectioned perspective view of an end portion of a fabric in the machine direction essentially parallel to the warp yarns showing the pin required for a pin seam entered into the seaming loops.

FIG. 5 shows one fabric end prepared according to this invention for seaming using a pin seam instead of a coil seam. The fabric shown in FIG. 5 is the same as that in FIG. 1. In FIG. 5 in addition to the pin 25 for the seam, the way in which the two sets of loops are arranged can be clearly seen. The warp 1 provides a loop at 1A around the pin 25 and then is rewoven into the fabric end in the adjacent warp path 1B. Similarly, the warp 2 provides a loop at 2A around the pin 25 and then is rewoven into the fabric end in the adjacent warp path 2B.

When a pin seam is used as shown in FIG. 5 it is advantageous to select the first angle and the second angle for the loops on one end of the fabric to match the corresponding angles for the loops on the other end of the fabric, as this will facilitate interdigitation of the two fabric ends for insertion of the seam pin into the interdigitated loops.

In the fabric shown in FIGS. 1, 2, 3 and 4, flattened warp yarns are used as taught by Lee in the noted U.S. patents.

The seam structure of this invention has been found to provide improved tensile strength in comparison with prior art seams in similar fabrics primarily due to the use of all of the warp yarns in the seam structure. Additionally, the use of doubled loops with one warp yarn inside the other makes it possible for each of the loops to follow more closely the angular orientation of the coil. This allows the areas adjacent the seam to be flatter, and far less prone to marking the wet paper web. Second, by locating the two yarns in each loop more or less concentrically, more space is provided between the loops for the seaming coils which permits the use of a larger monofilament yarn for the coil closer in size to the monofilament yarn used for the warp yarns in the fabric Additionally, this also allows the use of somewhat wider monofilament warp yarns in the fabric. The net effects of these are to increase the tensile strength of both the seam area and of the fabric, and to increase the working life of the fabric.

In FIGS. 3 and 4 the coil shown is not circular, but is flattened into a somewhat oblate cross sectional shape. This form of coil has the advantage that the caliper of the seam is lessened, which contributes to ensuring smoothness of the paper side surface especially in the seam area.

The invention claimed is:

1. A woven industrial fabric, having a machine direction (MD) and a cross-machine direction (CD) and comprising a fabric body with opposing first and second fabric ends each oriented in the CD and each comprising a seaming area, the fabric further having opposing first and second lateral edges each oriented in the MD, an upper surface and a lower surface which together form the fabric body and comprising CD oriented weft yarns and MD oriented warp yarns interwoven with the weft yarns in a weave pattern in which:

(a) in the fabric body, all of the warp yarns comprise vertically stacked pairs of upper and lower warp yarns, the upper warp yarns each following an upper body path, and the lower warp yarns each following a lower body path; and (b) in each of the seaming areas, each of the upper warp yarns follows an upper seaming path in the upper surface which passes from the upper surface to the lower surface to form a yarn loop, passes under at least one weft yarn and thereafter follows a lower seaming path in the lower surface, wherein (i) the lower seaming path is vertically stacked below the upper seaming path of an adjacent warp yarn towards a selected one of the first and second lateral edges; and (ii) in the seaming area, the yarn loops form concentric pairs, each pair comprising (A) an outer loop canted at a first angle to the MD; and (B) an inner loop canted at a second angle to the MD.

2. A fabric according to claim 1, wherein the first angle and the second angle are oriented towards each other in the MD.

3. A fabric according to claim 1, wherein the first angle and the second angle are substantially similar.

4. A fabric according to claim 1, wherein the fabric ends are closed by a coil having a spiral angle to form a coil seam, and the first angle and the second angle are each selected to correspond to the direction of the spiral angle.

5. A fabric according to claim 1, wherein the fabric ends are prepared for closing by a pintle to form a pin seam, and the first angle and the second angle are each selected to provide for the loops on the first fabric end to be located opposite to spaces between the loops on the second fabric end, to facilitate interdigitation of the loops on the first and second fabric ends.

6. A fabric according to claim 1, wherein the warp yarns are monofilaments.

7. A fabric according to claim 1, wherein the fabric is a papermaking fabric.

8. A fabric according to claim 7, wherein the fabric is a dryer fabric for a papermaking machine.

* * * * *

UNITED STATES PATENT AND TRADEMARK OFFICE

CERTIFICATE OF CORRECTION

PATENT NO. : 7,448,416 B2
APPLICATION NO. : 10/599080
DATED : November 11, 2008
INVENTOR(S) : James Harrison It is certified that error appears in the above-identified patent and that said Letters Patent is hereby corrected as shown below:

At column 1, line 6, after the word “or”, delete “‘pin”, and insert therefor --pin--.
At column 4, line 35, delete the words “lawyer two”, before the word “layer”.
At column 7, line 42, after the word “fabric” insert --.--.

Signed and Sealed this

Twenty-third Day of June, 2009

JOHN DOLL
*Acting Director of the United States Patent and Trademark Office*